US007813225B2

(12) United States Patent
Urano

(10) Patent No.: US 7,813,225 B2
(45) Date of Patent: Oct. 12, 2010

(54) TIME ADJUSTMENT DEVICE, TIMEPIECE WITH A TIME ADJUSTMENT DEVICE, AND TIME ADJUSTMENT METHOD

(75) Inventor: Osamu Urano, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 11/955,113

(22) Filed: Dec. 12, 2007

(65) Prior Publication Data

US 2008/0165626 A1 Jul. 10, 2008

(30) Foreign Application Priority Data

Jan. 10, 2007 (JP) ..... 2007-002729

(51) Int. Cl.
*G04C 11/02* (2006.01)

(52) U.S. Cl. ..... 368/47

(58) Field of Classification Search ..... 368/10, 368/46, 47; 370/503, 509; 375/354, 356; 455/550, 556.1, 566
See application file for complete search history.

(56) References Cited

U.S. PATENT DOCUMENTS 5,510,797 A * 4/1996 Abraham et al. ..... 342/352
6,212,133 B1 * 4/2001 McCoy et al. ..... 368/9
6,282,431 B1 * 8/2001 Konno ..... 455/425
6,300,899 B1 * 10/2001 King ..... 342/357.12
6,563,765 B1 * 5/2003 Ishigaki ..... 368/47
6,671,291 B1 12/2003 Soliman
6,963,588 B1 * 11/2005 Lynch et al. ..... 370/516
7,139,225 B2 * 11/2006 Farmer ..... 368/46
7,385,878 B2 * 6/2008 Cho ..... 368/46
7,474,651 B2 * 1/2009 Ozawa ..... 370/350
2001/0050633 A1 12/2001 Thomas
2004/0190378 A1 * 9/2004 Farmer ..... 368/47
2007/0230285 A1 * 10/2007 Nakagawa ..... 368/47

FOREIGN PATENT DOCUMENTS

JP 2000-321383 11/2000
JP 2003-279678 10/2003

* cited by examiner

*Primary Examiner*—Vit W Miska

(57) ABSTRACT

A time adjustment device has a reception unit that receives a prescribed signal containing time information transmitted by a base station, a display time information adjustment unit that adjusts the time information displayed by a time information display unit based on the time information, a base station identification information acquisition unit that gets base station identification information contained in the prescribed signal, and a time adjustment execution determination unit that decides based on the base station identification information whether the display time information adjustment unit adjusts the displayed time information using the time information from the prescribed signal.

7 Claims, 14 Drawing Sheets

SYNC CHANNEL (32) MESSAGE

| Field | bits | Note |
|---|---|---|
| P_REV | 8 | protocol version (CDMA type 1 - 6) |
| MIN_P_REV | 8 | lowest protocol version |
| SID | 15 | system ID |
| NID | 16 | network ID |
| PILOT_PN | 9 | PN signal 2^15 64-chip shift short pilot PN offset (0 - 512) |
| LC_STATE | 42 | Page Long PN 1 cycle = 2^42-1/1.2288 Mbpo = 41.42 days |
| SYS_TIME | 36 | system time (80 ms units) |
| LP_SEC | 8 | leap seconds (1 s units) |
| LTM_OFF | 6 | local offset time (1800 s units) |
| DAYLT | 1 | daylight savings time (0: off, 1: on) |
| PRAT | 2 | Paging Channel data rate 00:9800 bps, 01: 4800 bps |
| CDMA_FREQ | 11 | reserved Paging Channel setting |
| EXT_CDMA_FREQ | 11 | high speed Paging Channel setting |

LOCAL_TIME[a] = (SYS_TIME - (LP_SEC x 12.5) + (LTM_OFF x 22500)) x 0.08

FIG.12

TIME ADJUSTMENT DEVICE, TIMEPIECE WITH A TIME ADJUSTMENT DEVICE, AND TIME ADJUSTMENT METHOD

CROSS-REFERENCE TO RELATED APPLICATIONS

Japanese Patent application No. 2007-002729 is hereby incorporated by reference in its entirety.

BACKGROUND

1. Field of Invention

The present invention relates to a time adjustment device that adjusts the time based on time information contained in signals transmitted from the base station of a CDMA (Code Division Multiplex Access) cell phone network, for example. The invention also relates to a timepiece having the time adjustment device, and to a time adjustment method.

2. Description of Related Art

Time information is contained in signals transmitted to cell phones from the base stations in modern CDMA cell phone networks. This time information is extremely precise time information that matches the GPS time, which is based on the atomic clocks on GPS (Global Positioning System) satellites.

Japanese Unexamined Patent Appl. Pub. JP-A-2000-321383 (see the abstract) teaches a terminal that acquires the GPS time data transmitted from a base station of a CDMA cell phone network, and uses the GPS time data to correct the time kept by an internal clock.

CDMA cell phone networks are, however, operated by multiple different cell phone service providers. The reliability of the time information in signals transmitted from the base stations of these cell phone service providers may therefore differ according to the cell phone service provider.

Therefore, in order to ensure that a time adjustment device can accurately adjust the time based on the time information received from the base station, the circuit design and parameters, for example, of the time adjustment device must match the particular cell phone service provider, thus increasing the production cost.

SUMMARY

The time adjustment device, the timepiece having the time adjustment device, and the time adjustment method of the invention enable setting the time with good precision at a low cost.

A time adjustment device according to a first aspect of the invention has a reception unit that receives a prescribed signal containing time information transmitted by a base station, a display time information adjustment unit that adjusts the time information displayed by a time information display unit based on the time information, a base station identification information acquisition unit that gets base station identification information contained in the prescribed signal, and a time adjustment execution determination unit that decides based on the base station identification information whether the display time information adjustment unit adjusts the displayed time information using the time information from the prescribed signal.

In this aspect of the invention the time adjustment has a base station identification information acquisition unit that gets base station identification information contained in the prescribed signal, and a time adjustment execution determination unit that decides based on the base station identification information whether the display time information adjustment unit adjusts the displayed time information using the time information from the prescribed signal.

This aspect of the invention can select a target base station and adjust the time based on time information from the selected base station.

As a result, if the reliability, for example, of the time information differs according to the base stations managed by a cell phone service provider, the time adjustment device does not need to have circuitry that is compatible with the reliability level of the time information from all base stations.

The time adjustment device therefore only requires a circuit arrangement that is compatible with the reliability, for example, of the time information in signals from the base stations operated by the cell phone service provider, and the time adjustment device can adjust the time with good precision at a low cost.

Preferably, the time adjustment device also has a base station identification standard information storage unit that stores base station identification standard information that is the basis for decisions by the time adjustment execution determination unit.

Because this aspect of the invention has a base station identification standard information storage unit that stores base station identification standard information that is the basis for decisions by the time adjustment execution determination unit, the time adjustment device can reliably identify the base station that transmitted the time information that the time adjustment device uses as the standard for adjusting the time. The time can therefore be adjusted efficiently and with good precision.

Further preferably, the prescribed signal is a sync channel message, and the base station identification information is a system ID indicating that a base station is operated by a prescribed cell phone service provider Further preferably, the time adjustment device also has a leap seconds information storage unit for storing leap seconds information that is time adjustment information based on rotation of the Earth and is contained in the time information, and a leap seconds application time information storage unit that stores leap seconds application time information for adjusting the displayed time information based on the leap seconds information, and the display time information adjustment unit corrects the displayed time information based on the leap seconds information and the leap seconds application time information.

This aspect of the invention is an arrangement having a leap seconds information storage unit for storing leap seconds information that is time adjustment information based on rotation of the Earth and is contained in the time information, and a leap seconds application time information storage unit that stores leap seconds application time information for adjusting the displayed time information based on the leap seconds information, and the display time information adjustment unit corrects the displayed time information based on the leap seconds information and the leap seconds application time information.

As a result, if the time adjustment device gets the leap seconds information before the leap seconds information should be used, the received leap seconds information is not used immediately to adjust the displayed time information and the displayed time information is instead adjusted based on the leap seconds information when the leap seconds information is to be used.

The leap seconds information acquired from the base station can therefore be accurately reflected in the time adjustment.

Further preferably, the time adjustment device also has a time information extraction signal supply unit that supplies only a time information extraction signal, and the time information is extracted from the prescribed signal using the time information extraction signal.

This aspect of the invention has a time information extraction signal supply unit that supplies only the time information extraction signal used for extracting time information from the prescribed signal containing time information transmitted by a base station. The size of the circuit rendering this time information extraction signal supply unit can therefore be reduced compared with the related art, and the power consumption of the time adjustment device can be reduced.

Yet further preferably, the time information is future time information for a specific time after the reception time information, which is the time the reception unit receives, and the time adjustment device also has a time difference information storage unit that stores the time difference between the future time information and the reception time information, a reception time information generating unit that generates the reception time information of the reception unit based on the future time information received by the reception unit and the time difference information, and an adjustment time information generating unit that generates adjustment time information for adjusting the display time information adjustment unit based on the reception time information generated by the reception time information generating unit and at least processing time information for the time adjustment device.

Another aspect of the invention is a timepiece device having a time adjustment device, and including a reception unit that receives a prescribed signal containing time information transmitted by a base station, a display time information adjustment unit that adjusts the time information displayed by a time information display unit based on the time information, a base station identification information acquisition unit that gets base station identification information contained in the prescribed signal, and a time adjustment execution determination unit that decides based on the base station identification information whether the display time information adjustment unit adjusts the displayed time information using the time information from the prescribed signal.

Another aspect of the invention is a time adjustment method for a time adjustment device, wherein the time adjustment device has a reception unit that receives a prescribed signal containing time information transmitted by a base station, and a display time information adjustment unit that adjusts the time information displayed by a time information display unit based on the time information, and the time adjustment method has a base station identification information acquisition step of a base station identification information acquisition unit getting base station identification information contained in the prescribed signal, and a time adjustment execution determination step of a time adjustment execution determination unit deciding based on the base station identification information whether the display time information adjustment unit adjusts the displayed time information using the time information from the prescribed signal.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 12 is a schematic diagram describing the content of the sync channel message.

DESCRIPTION OF THE PREFERRED EMBODIMENTS

A preferred embodiment of the present invention is described below with reference to the accompanying figures.

The embodiment described below has various technically desirable limitations because it is a specific preferred embodiment of the invention, but the scope of the invention is not limited to the following embodiment unless some aspect described below is specifically said to limit the invention.

Figure 1:
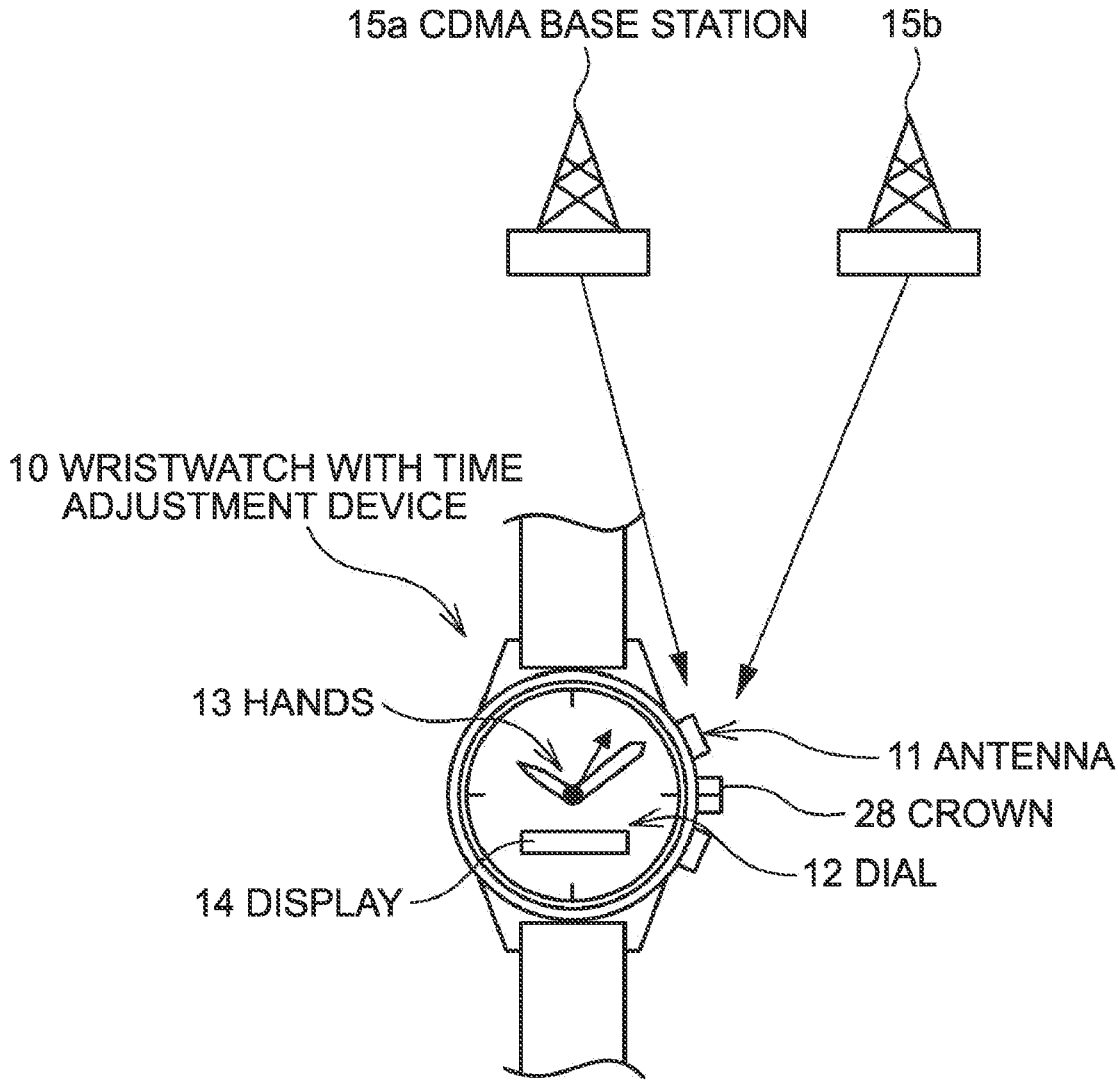
FIG. 1 is a schematic diagram showing a wristwatch with a time adjustment device as an example of a timepiece having a time adjustment device according to the invention.
Figure 2:
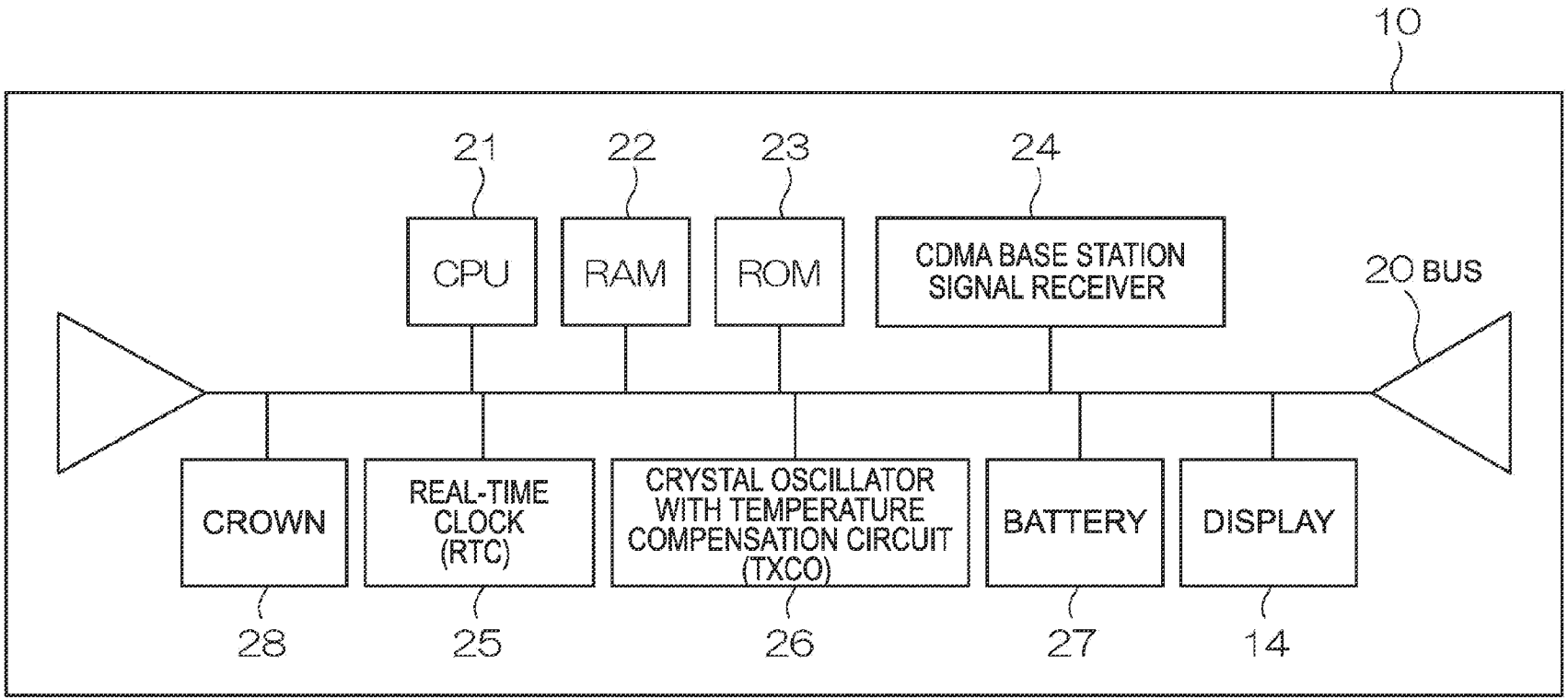
FIG. 2 is a schematic diagram showing the main internal hardware arrangement of the wristwatch shown in FIG. 1.

FIG. 1 is a schematic diagram showing a wristwatch with a time adjustment device 10 (referred to below as simply a wristwatch) as an example of a timepiece with a time adjustment device according to the present invention, and FIG. 2 is a block diagram describing the main internal hardware configuration of the wristwatch 10 shown in FIG. 1.

As shown in FIG. 1 the wristwatch 10 has a dial 12 on the face, hands 13 including a long hand and a short hand, and a display 14 such as an LED for displaying messages. The display 14 could be an LCD or analog display, for example, instead of an LED.

As also shown in FIG. 1 the wristwatch 10 has an antenna 11, and this antenna 11 is arranged to receive signals from a base station such as CDMA base stations 15*a* and 15*b*. More specifically, these CDMA base stations 15*a* and 15*b* are base stations on a CDMA cell phone network.

The wristwatch 10 in this embodiment of the invention does not have a cell phone function and therefore does not enable voice communication with the CDMA base stations 15*a*, but receives time information, for example, from the signals transmitted from the CDMA base stations 15*a* and adjusts the time based on these received signals. The content of the signals from the CDMA base stations 15*a* is further described below.

As also shown in FIG. 1 the wristwatch 10 has a crown 28 that can be operated by the user.

This crown 28 is an example of an external input unit that can be operated by the user.

The hardware arrangement of the wristwatch 10 is described next.

As shown in FIG. 2 the wristwatch 10 has a bus 20, and a CPU (central processing unit) 21, RAM (random access memory) 22, and ROM (read-only memory) 23 are connected to the bus 20.

A reception unit for receiving signals from the CDMA base stations 16*a*, such as CDMA base station signal receiver 24, is connected to the bus 20. The CDMA base station signal receiver 24 has the antenna 11 shown in FIG. 1.

A real-time clock (RTC) 25 that is a timekeeping mechanism rendered as an IC device (semiconductor integrated circuit), for example, and a crystal oscillator with temperature compensation circuit (TCXO) 26, are also connected to the 20.

The dial 12 and hands 13 shown in FIG. 1, and the RTC 25 and TCXO 26 are thus an example of a time information display unit for displaying time information.

A battery 27 is also connected to the bus 20, and the battery 27 is a power supply unit for supplying power for communication by the reception unit (such as the CDMA base station signal receiver 24).

The display 14 and the crown 28 shown in FIG. 1 are also connected to the bus 20. The bus 20 is thus an internal bus that has a function for connecting all of the other devices and has addresses and data paths. The RAM 22 is used as working memory by the CPU 21 for executing specific programs and controlling the ROM 23 connected to the bus 20. The CPU 21 executes specific programs and controls the ROM 23 connected to the bus 20. The ROM 23 stores programs and data.

Figure 3:
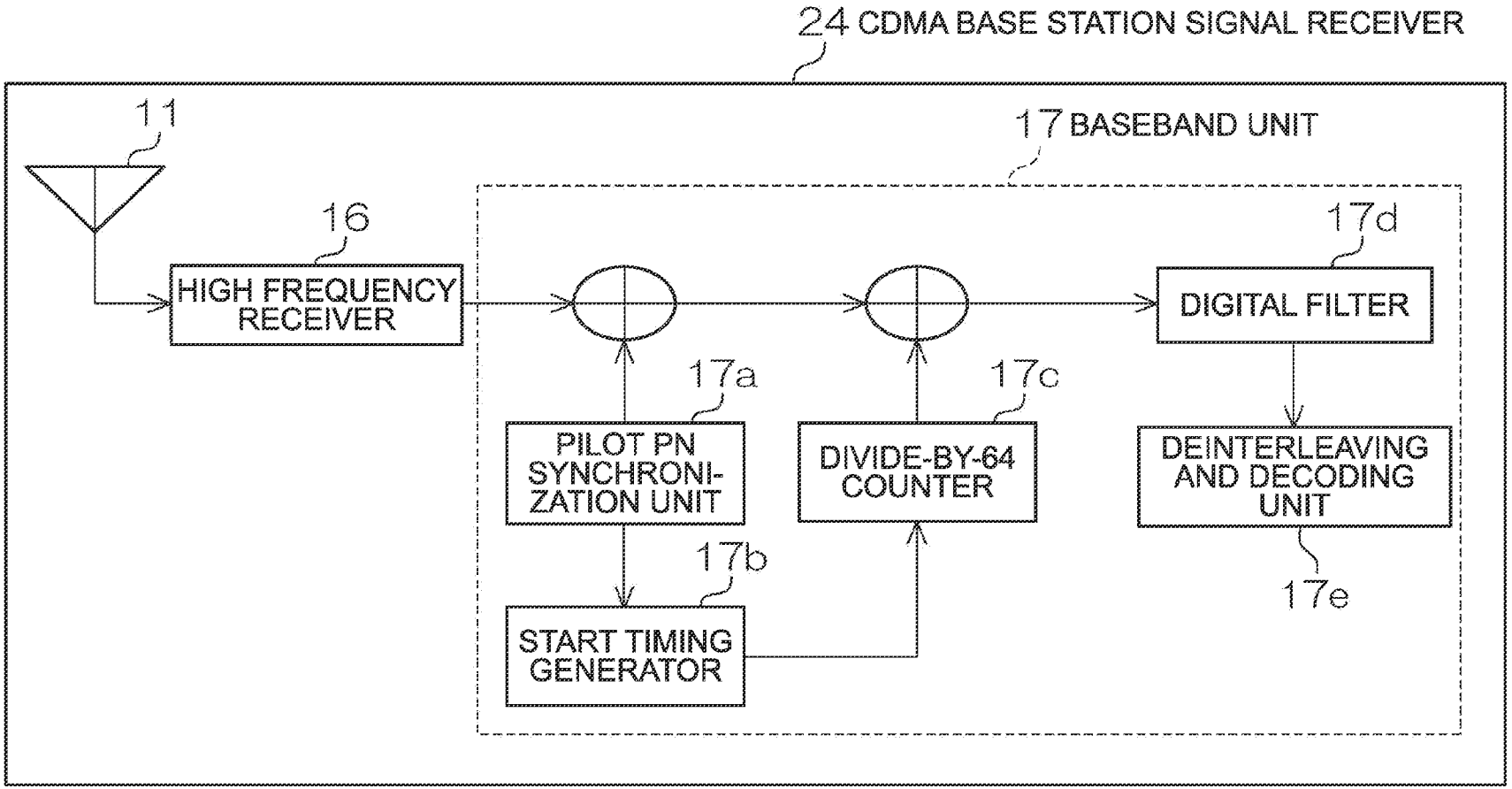
FIG. 3 is a schematic diagram showing the basic arrangement of the CDMA base station signal receiver shown in FIG. 2.

FIG. 3 is a schematic diagram showing the basic arrangement of the CDMA base station signal receiver 24 shown in FIG. 2. As shown in FIG. 3 a high frequency receiver 16 is connected to the antenna 11. This high frequency receiver 16 down-converts signals received by the antenna 11 from the CDMA base stations 15*a*, for example.

A baseband unit 17 is also connected to the high frequency receiver 16. Inside the baseband unit 17 is a pilot PN synchronization unit 17*a*. This pilot PN synchronization unit 17*a* mixes the pilot PN code with the pilot channel signal downloaded by the high frequency receiver 16 for signal synchronization.

A start timing generator 17*b* is also connected to the pilot PN synchronization unit 17*a*. The pilot PN synchronization unit 17*a* inputs the timing at which the signal was synchronized to the start timing generator 17*b*, and based on this input the start timing generator 17*b* generates the start timing.

As shown in FIG. 3 the start timing generator 17*b* is connected to a divide-by-64 counter 17*c*. The start timing generated by the start timing generator 17*b* is thus input to the divide-by-64 counter 17*c* and frequency division starts.

As further described below, the divide-by-64 counter 17*c* divides the frequency of the pilot PN chip rate, that is, 1.2288 MHz, by 64 and generates Walsh code (32). The resulting Walsh code (32) is mixed with the sync channel signal received by the antenna 11 to extract the time information. Processing these signals is described below.

The start timing generator 17*b* is an example of a start timing supply unit that supplies the start timing at which the divide-by-64 counter 17*c* starts frequency dividing the base frequency of, for example, the pilot PN chip rate (1.2288 MHz).

The divide-by-64 counter 17*c* is a frequency division counter unit that frequency divides the basic unit of a prescribed signal, such as the 1.2288 MHz frequency of the pilot PN signal, and generates a time information extraction signal, such as Walsh code (32).

The baseband unit 17 also has a digital filter 17*d* and a deinterleaving and decoding unit 17*e* as shown in FIG. 3. That is, the signal received by the antenna 11 passes the digital filter 17*d* and then the deinterleaving and decoding unit 17*e* after mixing the Walsh code (32) as described above, is demodulated, and is extracted as the sync channel message described below.

Figure 4:
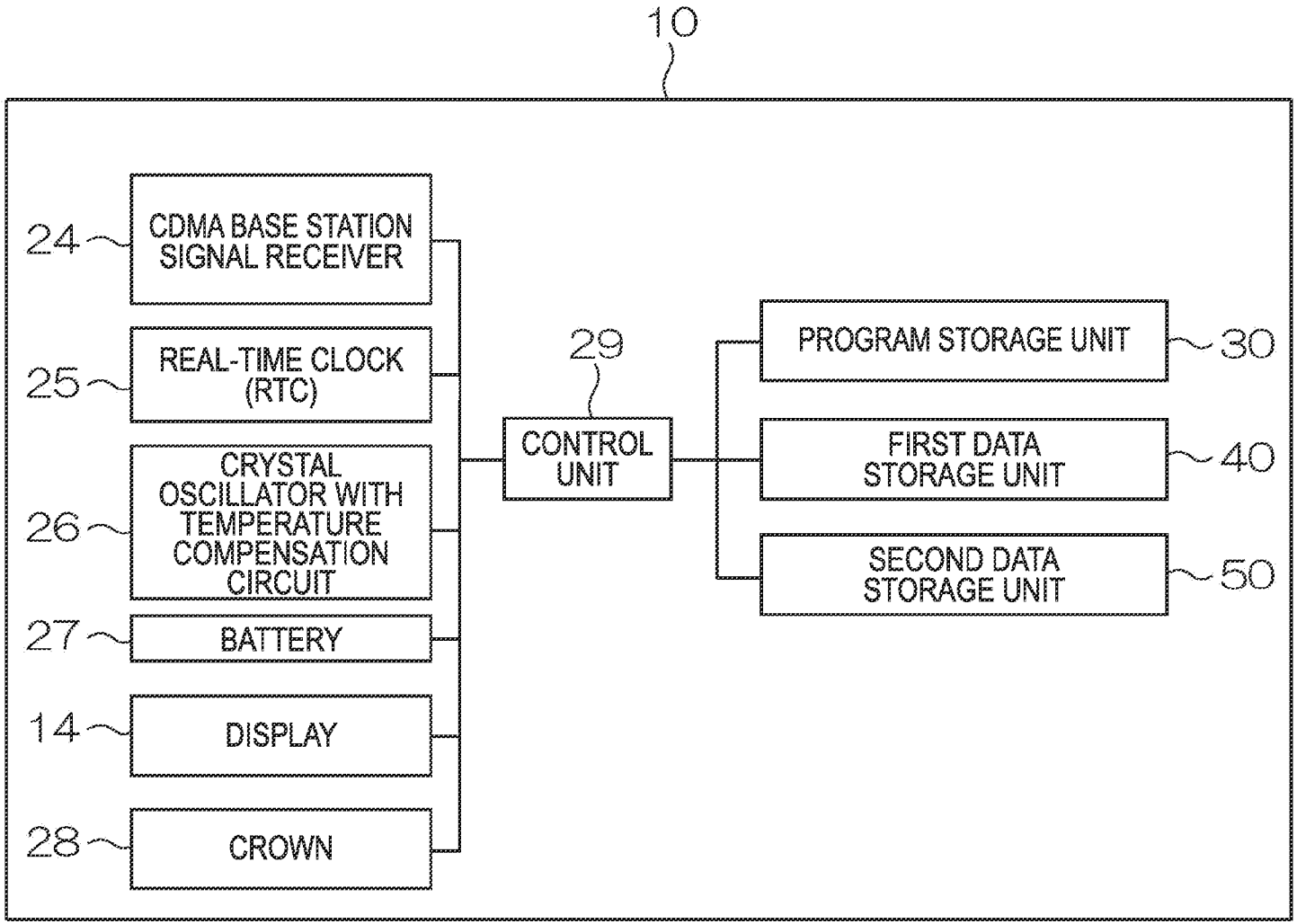
FIG. 4 is a schematic diagram showing the main software configuration of the wristwatch.

FIG. 4 to FIG. 7 are schematic diagrams showing the main software arrangement of the wristwatch 10. FIG. 4 is an overview.

As shown in FIG. 4 the wristwatch 10 has a control unit 29, and the control unit 29 runs the programs stored in the program storage unit 30 shown in FIG. 4 and processes the data in the first data storage unit 40 and the data in the second data storage unit 50.

Note that the program storage unit 30, the first data storage unit 40, and the second data storage unit 50 are shown separately in FIG. 4, but in practice the data is not stored in separate devices and is shown this way for descriptive convenience only.

In addition, primarily data that is predefined is stored in the first data storage unit 40 in FIG. 4. In addition, primarily data that results from processing the data in the first data storage unit 40 by running the programs shown in the program storage unit 30 is stored in the second data storage unit 50.

Figure 5:
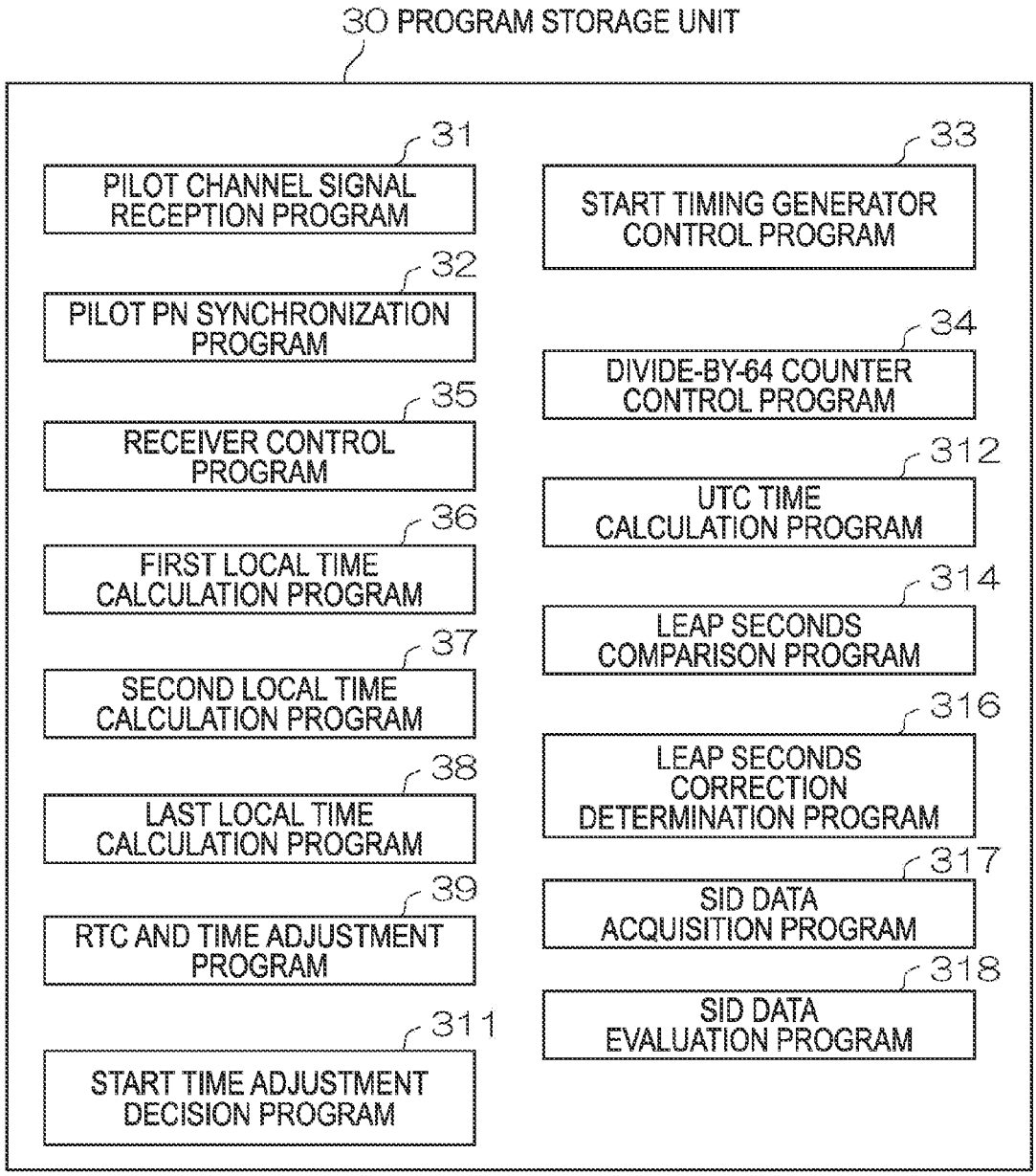
FIG. 5 is a schematic diagram showing data stored in the program storage unit in FIG. 4.
Figure 6:
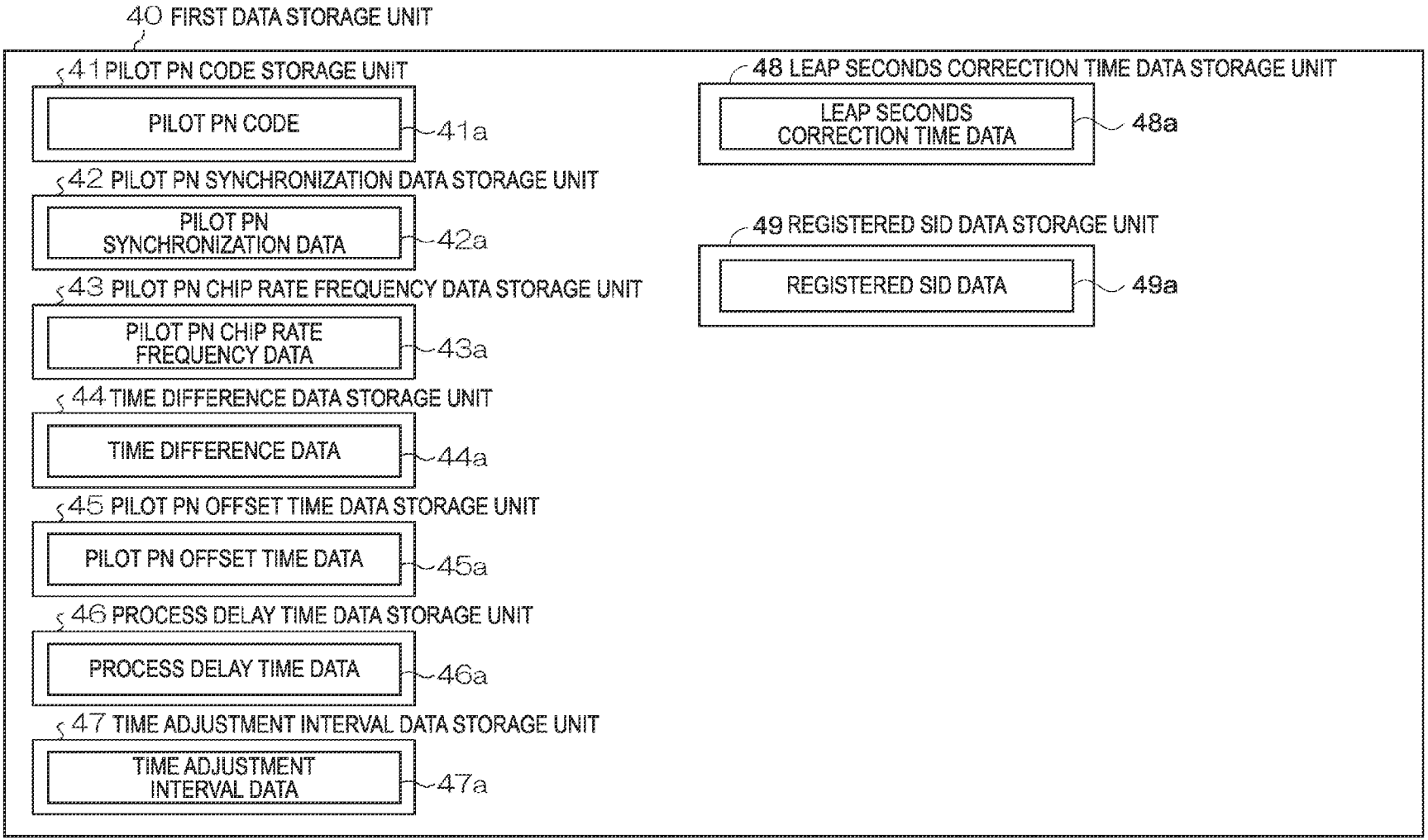
FIG. 6 is a schematic diagram showing data stored in the first data storage unit in FIG. 4.
Figure 7:
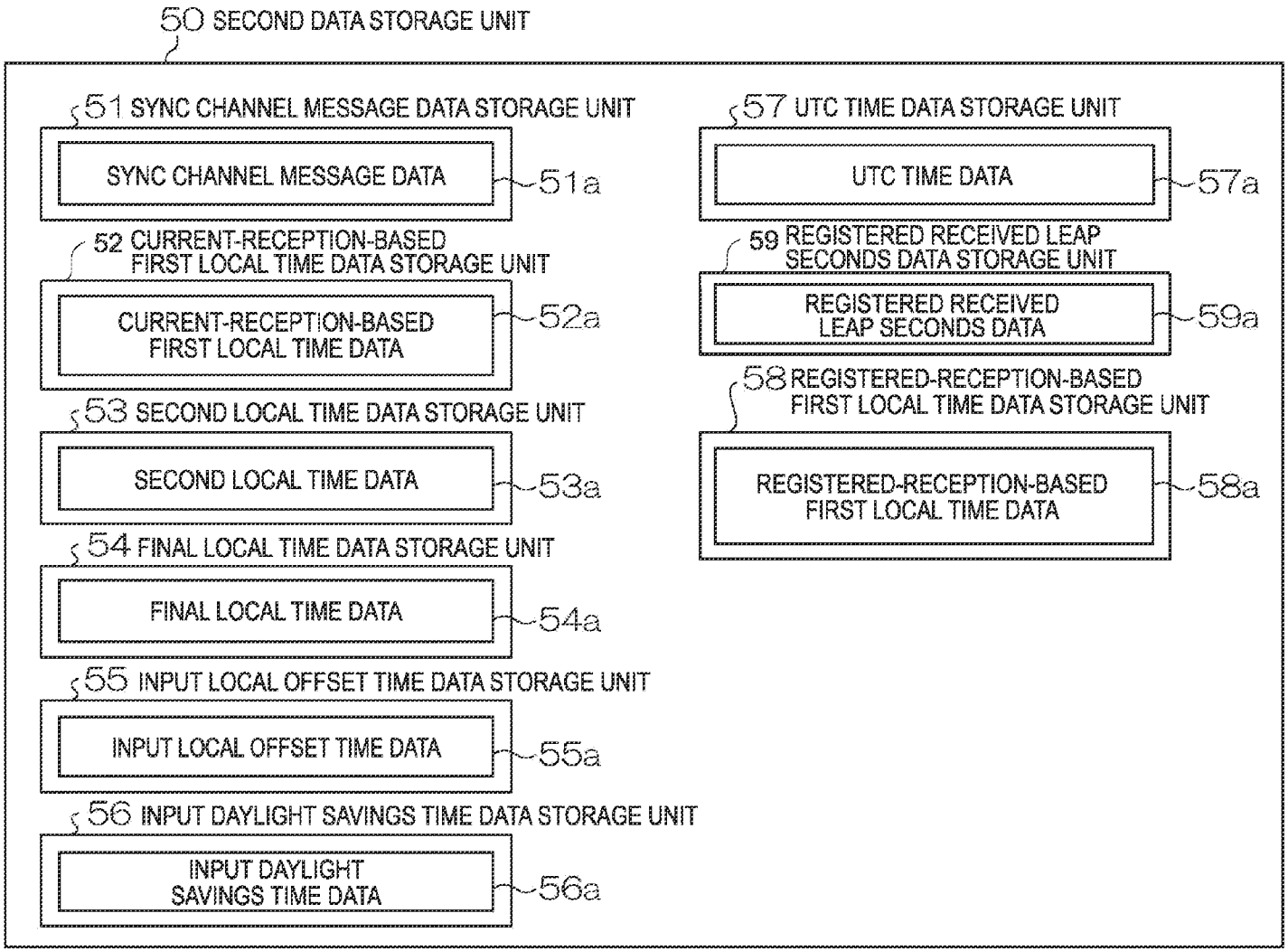
FIG. 7 is a schematic diagram showing data stored in the second data storage unit in FIG. 4.

FIG. 5 is a schematic diagram showing the data stored in the program storage unit 30 in FIG. 4, and FIG. 6 is a schematic diagram showing the data stored in the first data storage unit 40 in FIG. 4. FIG. 7 is a schematic diagram showing the showing the data stored in the second data storage unit 50 in FIG. 4.

Figure 8:
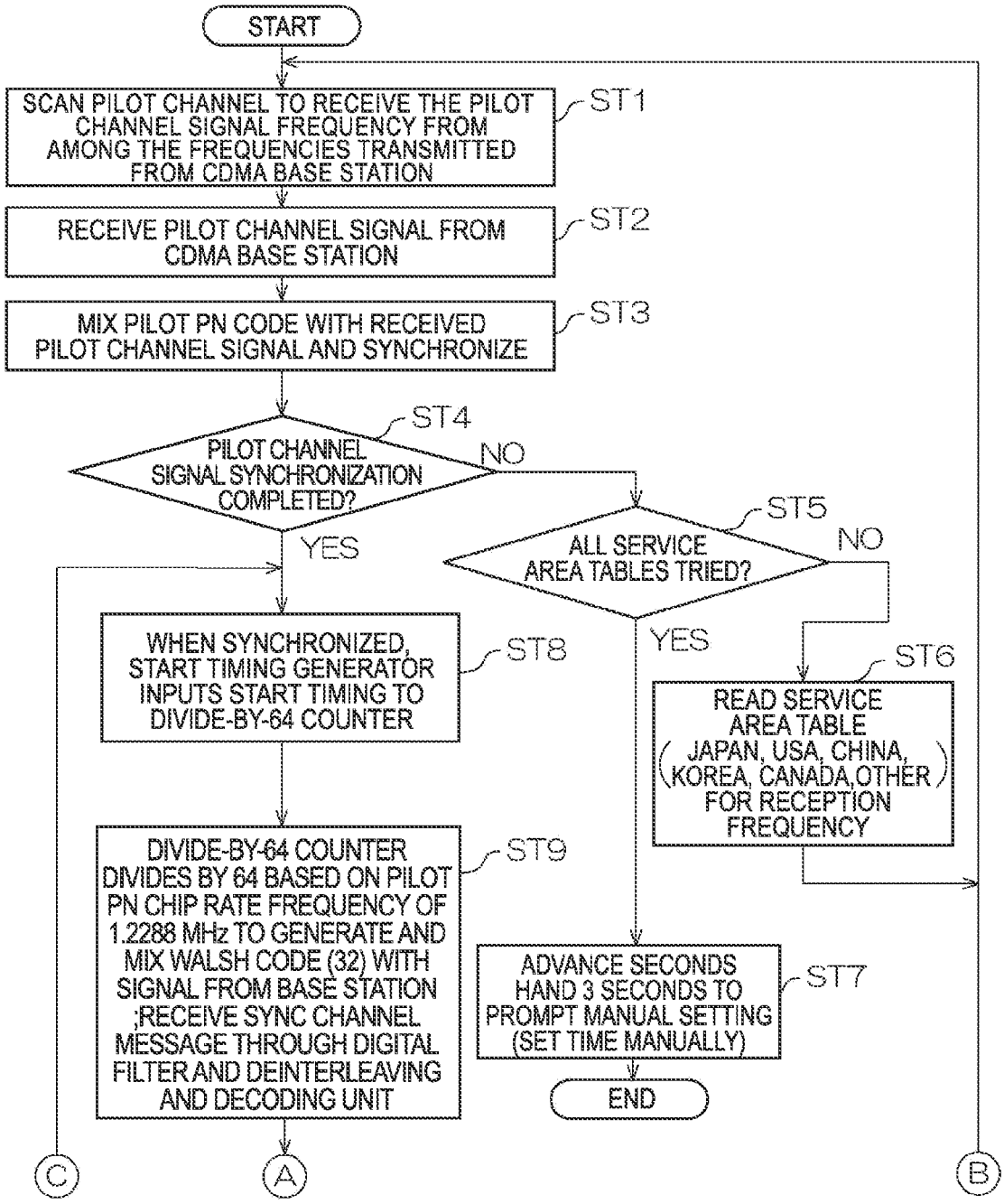
FIG. 8 is a flow chart describing the main operation of the wristwatch according to the invention.
Figure 9:
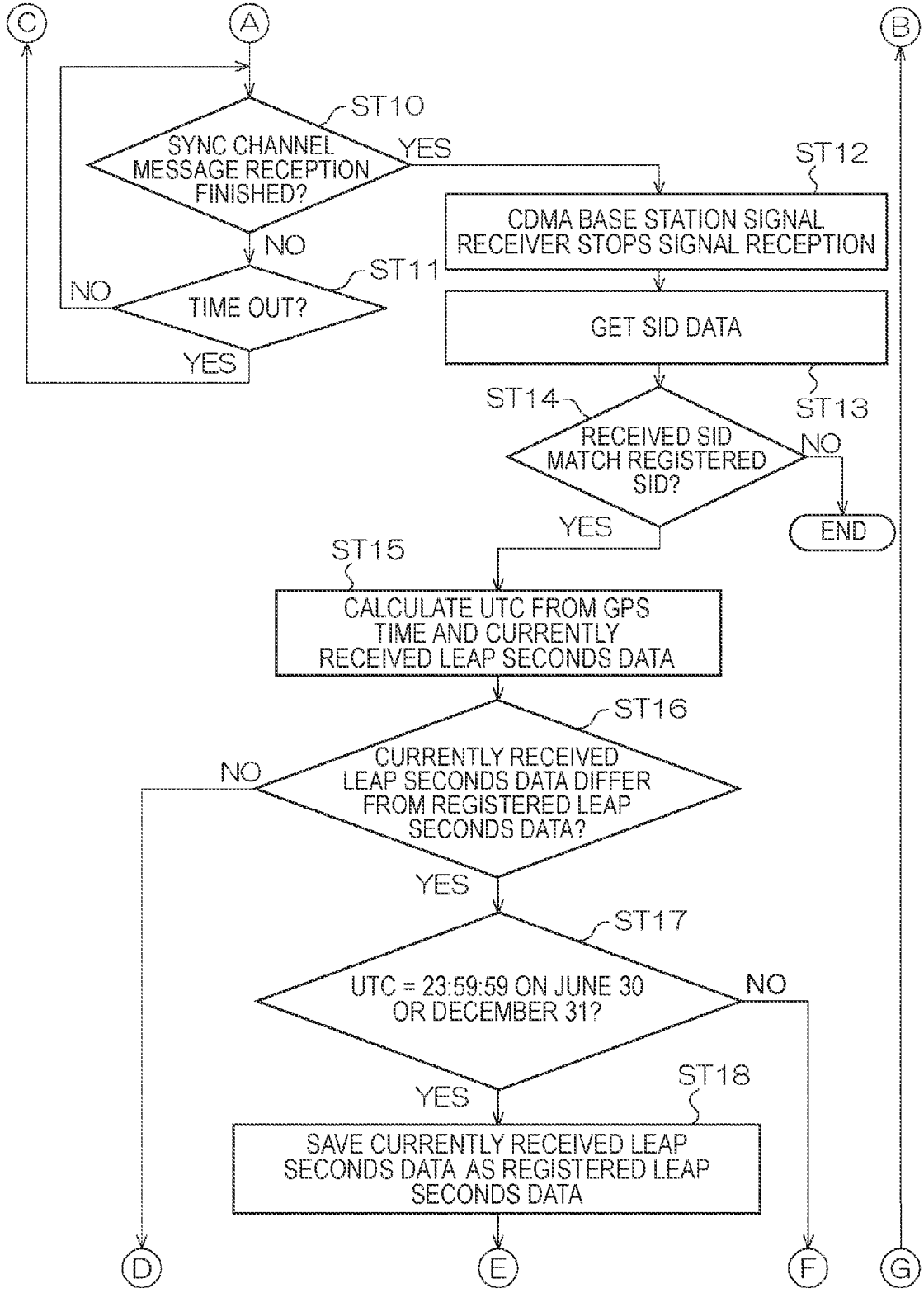
FIG. 9 is another flow chart describing the main operation of the wristwatch according to the invention.
Figure 10:
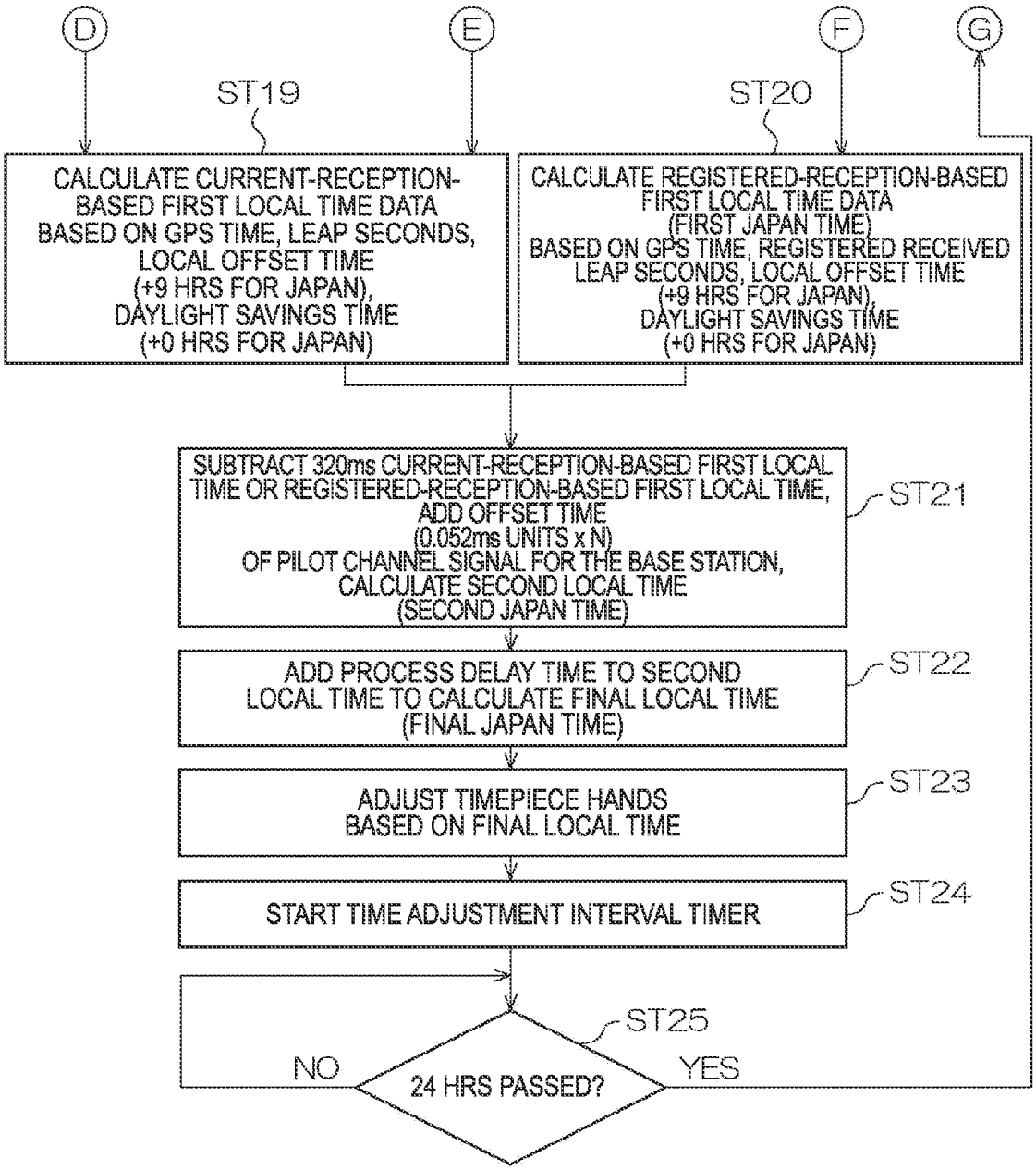
FIG. 10 is another flow chart describing the main operation of the wristwatch according to the invention.

FIG. 8 to FIG. 10 are flow charts describing the main operation of the wristwatch 10 according to this embodiment of the invention.

While describing the operation of the wristwatch 10 according to this embodiment of the invention with reference to the flow charts in FIG. 8 to FIG. 10, the programs and data related to this operation and shown in FIG. 5 to FIG. 7 are also described below.

Before proceeding to the description of the flow charts, the parts of the CDMA cell phone system that are related to the invention are described below.

The CDMA cell phone system started actual operation after the system developed by Qualcomm, Inc. of the United States was adopted in 1993 as the IS95 cell phone standard in the United States. This standard was later revised as IS95A, IS95, and then CDMA2000. A cell phone system conforming to ARIB STD-T53 is used in Japan.

Because the CDMA system is synchronized on the downlink (from the CDMA base station 15*a* to the mobile station, wristwatch 10 in this embodiment of the invention), the wristwatch 10 must synchronize with the signals from the CDMA base station 15*a*. The signals transmitted from the CDMA base station 15*a* include a pilot channel signal and a sync channel signal. The pilot channel signal is a signal that is transmitted from each CDMA base station 15*a* at a different timing, such as the pilot PN signal.

Figure 11:
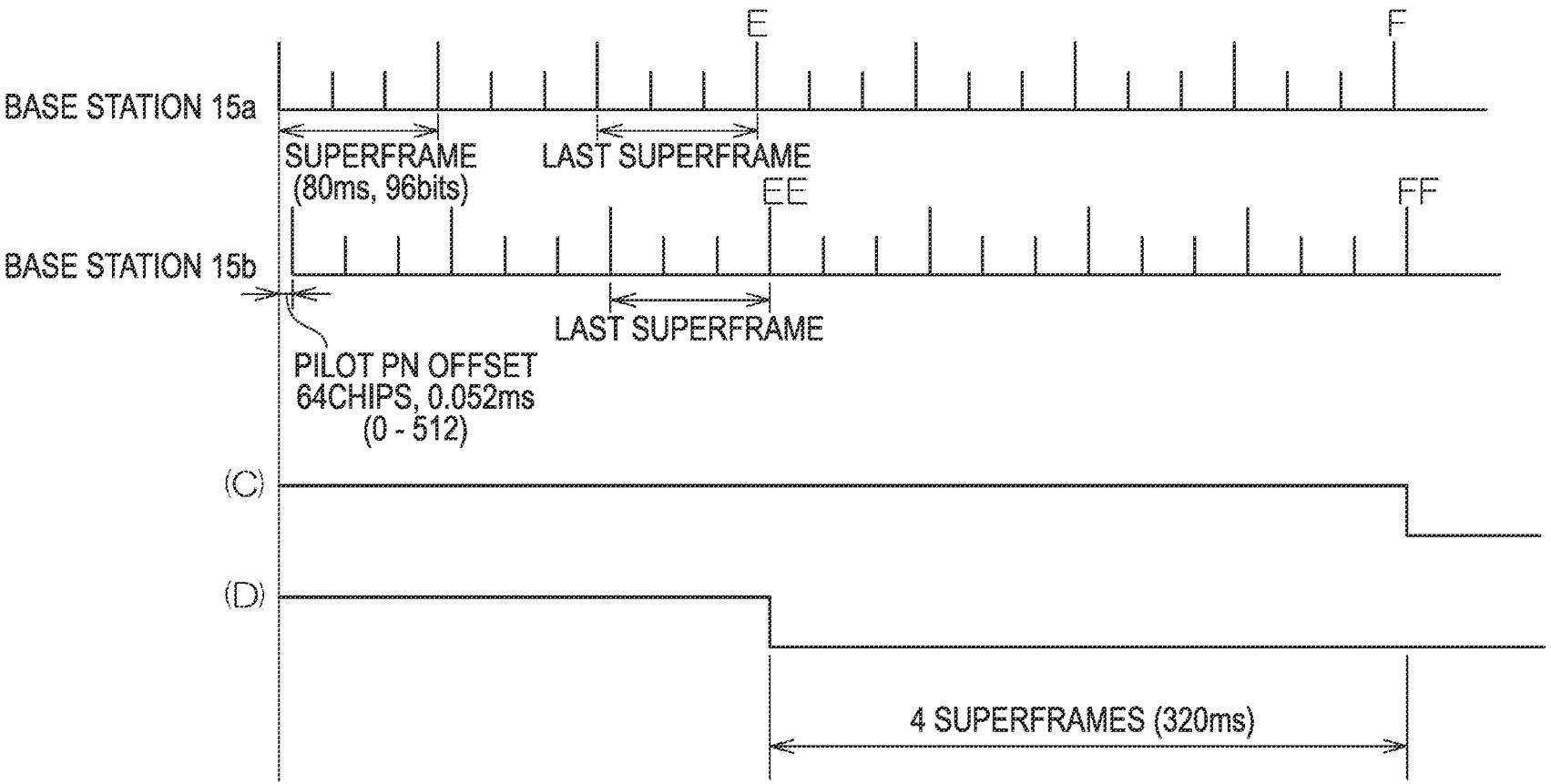
FIG. 11 describes the synchronization timing of signals transmitted from a CDMA base station.

FIG. 11 is a timing chart of the synchronization timing for signals transmitted from the CDMA base stations 15*a* and 15*b*.

Because the signals transmitted form the CDMA base stations 15*a* and 15*b* are the same, the signal transmission timing of each CDMA base station 15*a* differs from the signal transmission timing of each other CDMA base station 15*a* so that it can be determined which CDMA base station 15*a* transmitted a particular signal.

More specifically, these timing differences are expressed by differences in the pilot PN signal transmitted by the CDMA base station 15*a*. In FIG. 11, for example, the CDMA base station 15*b* transmits signals at a timing delayed slightly from the CDMA base station 15*a*. More specifically, there is a pilot PN offset of 64 chips (0.052 ms).

By each CDMA base station 15*a* providing a different pilot PN offset that is an integer multiple of 64 chips, the wristwatch 10 can easily determine the CDMA base station 15*a* from which a signal was received even when there are many CDMA base stations 15*a*.

The signals transmitted from the CDMA base station 15*a* also contain a sync channel signal, which is the sync channel message shown in FIG. 12. FIG. 12 shows the content of the sync channel message.

As shown in FIG. 12, the sync channel message contains data about the pilot PN signal, such as data showing that the pilot PN offset is 64 chips (0.052 ms)×N (0-512). This value is contained in the PILOT_PN field in FIG. 12.

The sync channel message also contains system time information, which is the GPS time.

The system time is the cumulative time in 80 ms units from 0:00 on Jan. 6, 1980. This value is contained in the SYS_TIME field in FIG. 12.

The sync channel message also contains a leap second value for UTC (Universal Time Code) conversion. This value is contained in the LP_SEC field in FIG. 12. For example, this is a value such as "13" seconds or "14" seconds. This leap seconds value is an example of leap seconds information that is time adjustment information contained in the time information and based on the rotation of the Earth, for example.

The sync channel message also contains the local offset time, which is the time difference between the country or region where the wristwatch 10 is located and the UTC. If the country is Japan, for example, a value indicating that the time difference to UTC is +9 hours is stored.

This value is stored in the LTM_OFF field in FIG. 12.

The sync channel message also contains a daylight savings time value indicating if the country or region where the wristwatch 10 is located uses daylight savings time. The value in this example is 0 because Japan does not use daylight savings time. This value is stored in the DAYLT field in FIG. 12.

The pilot PN signal data shown in FIG. 12 is thus base station time difference information for signals transmitted from a particular base station (such as CDMA base station 15*a*), and the local offset information is region time conversion information for converting to the local time. The daylight savings time data is seasonal time information for converting to the time of the current season.

A system ID (SID), which is a numeric value such as "1234," is also stored in the sync channel message in FIG. 12. This system ID is information for identifying the cell phone service provider that manages the CDMA base station 15*a*. More specifically, the same system ID is used for all CDMA base stations 15*a* operated by the same cell phone service provider.

This value is contained in the SID field in FIG. 12 and an ID of "1234" is used in this embodiment as the system ID indicating that the CDMA base station 15*a* is managed by cell phone service provider (A), for example.

The sync channel message is thus an example of a prescribed signal, and the system ID indicating the specific cell phone service provider that operates a base station is an example of base station identification information.

The wristwatch 10 in this embodiment of the invention is also preconfigured to adjust the time according to the reliability level, for example, of the time information in the sync channel message transmitted by cell phone service provider (A)

While the sync channel message shown in FIG. 12 contains data such as described above, the data is transmitted sequentially on the time base. The transmitted signals are transmitted in 80-ms superframe units as shown in FIG. 11, and the last superframe shown in FIG. 11 is the superframe that contains the last data in one sync channel message. The timing of the end of the last superframe in FIG. 11 (the parts denoted E and EE in FIG. 11) is thus the timing of the end of sync channel message reception.

The GPS time in the sync channel message shown in FIG. 12 is not the time at time E in FIG. 11 in the CDMA system, but is the time four superframes (320 ms) later, that is, at time F in FIG. 11.

More specifically, the GPS time is the time at four superframes from the time at the end of the last superframe referenced to the time when the above-described pilot PN offset is 0 chips (0 ms).

This is based on CDMA being a cell phone telecommunication system. More specifically, after the cell phone receives the sync channel message shown in FIG. 12 from a CDMA base station 15*a*, the cell phone needs to prepare internally for synchronized communication with the CDMA base station 15*a*.

That is, after preparing to shift to the next stage, standby, the cell phone synchronizes and communicates with the CDMA base station 15*a*.

Therefore, if the CDMA base station 15*a* sends a time in the future, such as the time 320 ms later, in advance to allow for this preparation time, and the cell phone receiving this time executes an internal process to prepare for communication and then attempts to synchronize with the CDMA base station 15*a*, synchronization is easier. In other words, these four superframes (320 ms) are preparation time for the cell phone.

The CDMA cell phone system used by this embodiment of the invention is described above, and the embodiment of the invention is described below with reference to this CDMA cell phone system.

To adjust the time of the wristwatch 10, the CDMA base station signal receiver 24 shown in FIG. 2 of the wristwatch 10 scans the pilot channel in order to receive the pilot channel signal from among the signals transmitted from the CDMA base station 15*a* shown in FIG. 1

Then, in ST2, the CDMA base station signal receiver 24 receives the pilot channel signal from the CDMA base station 15*a*. More specifically, the pilot channel signal reception program 31 in FIG. 5 operates.

The pilot PN code is then mixed with the received pilot channel signal to synchronize in ST3 in FIG. 8 and Walsh code (0) is overlayed (despreading) to get the data.

More specifically, the pilot synchronization program 32 in FIG. 5 operates, and the pilot PN synchronization unit 17*a* in FIG. 3 mixes the pilot PN code 41*a* stored in the pilot PN code storage unit 41 shown in FIG. 6 (the same code as the pilot PN code sent from the CDMA base station 15*a*) and Walsh code (0) as shown in FIG. 3 to synchronize. Preparing a special code is not necessary at this time because the mixed Walsh code is (0).

Because the pilot PN code is thus contained in the received pilot channel signal, the CDMA base station signal receiver 24 requires the same pilot PN code and Walsh code (0) to receive. The CDMA base station signal receiver 24 can thus synchronize with the pilot channel signal from the CDMA base station 15*a*, despread, and get data.

Figure 13A:
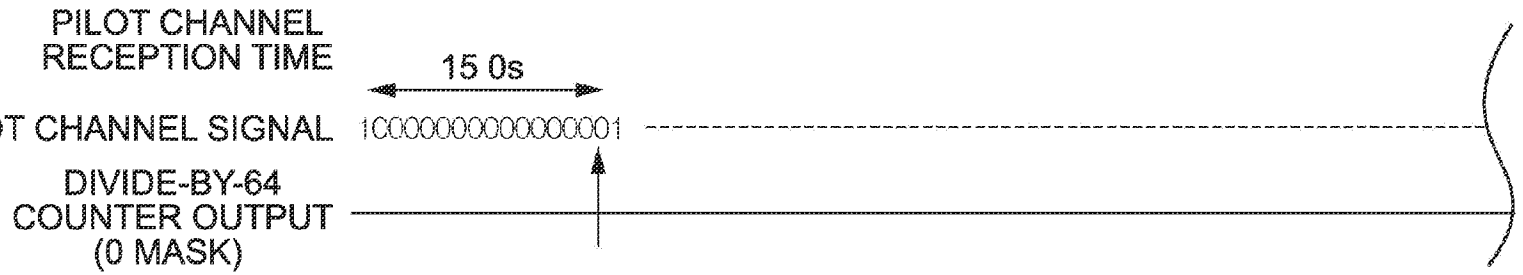
FIG. 13A is a schematic diagram describing the CDMA base station signal receiver synchronizing with the pilot channel signal.

FIG. 13A shows the CDMA base station signal receiver 24 synchronizing with the pilot channel signal.

As shown in FIG. 13A, the pilot channel signal contains a string of 15 consecutive zeroes (0), the last zero (0) (the position indicated by the vertical arrow in FIG. 13A) is used for synchronization, and data for synchronizing to this bit is contained in the pilot PN synchronization data 42*a*.

Signals synchronized this way are synchronized with a superframe every 80 ms as described in FIG. 11.

The pilot PN synchronization program 32 then determines if synchronization with the pilot channel signal of the CDMA base station 15*a* is completed in ST4. If synchronization is not finished, the CDMA base station signal receiver 24 determines in ST5 if all service area tables in the wristwatch 10 have been referenced (through one cycle), and if they have not been referenced, control goes to ST6.

The data for CDMA base stations 15*a* in Japan, the United States, China, and Canada, for example, is referenced in ST6, and the pilot channel is scanned in ST1 based on this data.

For example, if the wristwatch 10 is looking for a CDMA base station 15*a* in Japan but is actually in the United States, synchronization with the pilot channel is not possible in ST3. Data for the CDMA base stations 15*a* in the United States is then acquired in ST6, and the pilot channel is scanned in ST1 based on this data.

However, is synchronization with the pilot channel signal is not possible even though all service area tables in the wristwatch 10 have been referenced in ST6, control goes to ST7. To indicate for the user that the time has not been adjusted, the seconds hand in FIG. 1 is moved 3 seconds, for example, in ST7 to inform the user. Adjusting the time is then left to the user, and operation ends. The user of the wristwatch 10 can thus be informed that something is different from usual.

If synchronization with the pilot channel signal is completed in ST4, control goes to ST8 and the start timing generator 17*b* inputs the start timing to the divide-by-64 counter 17*c*.

In this case the start timing generator control program 33 in FIG. 5 operates to generate and input the start timing to the divide-by-64 counter 17*c* in FIG. 3.

Figure 13B:
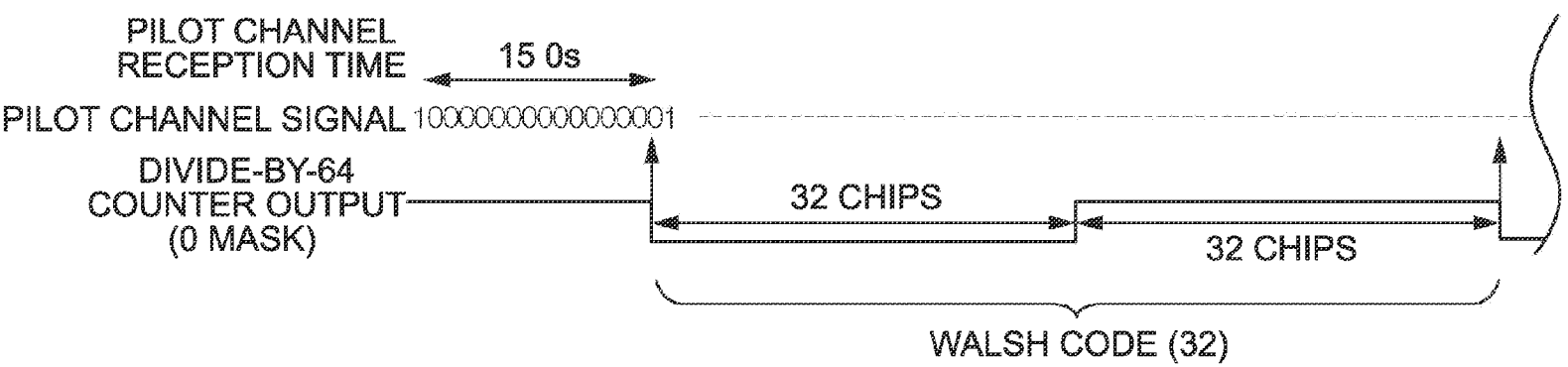
FIG. 13B is a schematic diagram describing the relationship between the start timing and a divide-by-64 counter.

This is shown and described more specifically in FIG. 13B. FIG. 13B schematically describes the relationship between the start timing and the operation of the divide-by-64 counter 17*c*.

As shown in the figure, the divide-by-64 counter in FIG. 13B outputs at the synchronization timing of the pilot channel signal in FIG. 13A as indicated by the vertical arrow in the figure, and the start timing signal is also input to the divide-by-64 counter 17*c* at the timing indicated by this vertical arrow.

In ST9 the divide-by-64 counter 17*c* starts operating and frequency dividing at the start timing input from the start timing generator 17*b*.

In this case the divide-by-64 counter 17*c* operates according to the divide-by-64 counter control program 34 in FIG. 5, divides the pilot PN chip rate frequency (1.2288 MHz) stored in the pilot PN chip rate frequency data storage unit 43 in FIG. 6 by 64, and generates a code as shown in FIG. 13B.

The length of this code is 64 chips including a 0 signal for the first 32 chips and a 1 signal for the second 32 chips, and is thus the same as the Walsh code (32) for getting data from the sync channel message in FIG. 12.

Figure 14:
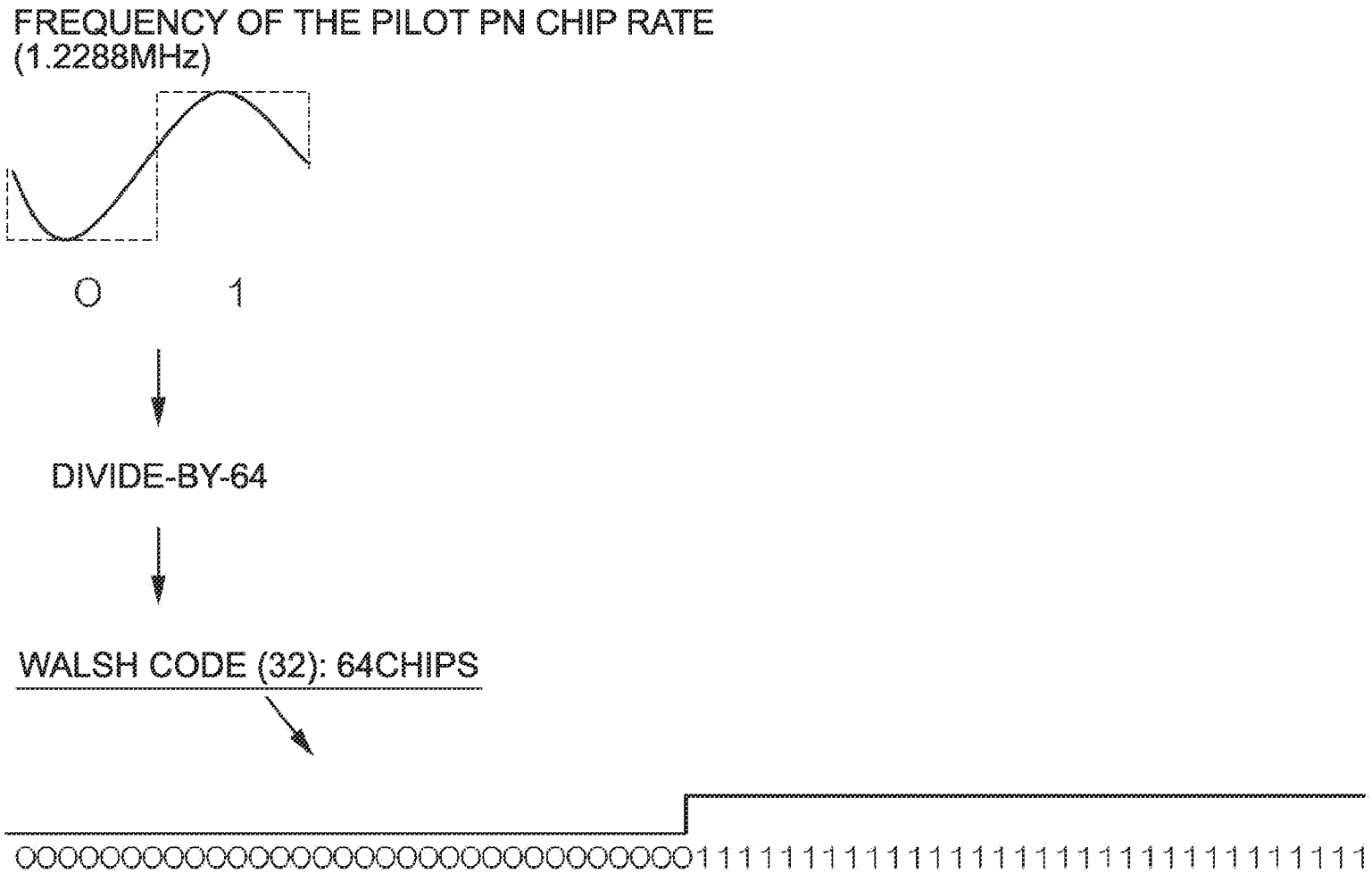
FIG. 14 is a schematic diagram describing the process of the frequency division counter frequency dividing the 1.2288 MHz chip rate of the pilot PN to generate Walsh code (32).

FIG. 14 schematically describes the process whereby the divide-by-64 counter 17*c* divides the pilot PN chip rate of 1.2288 MHz and generates the Walsh code (32).

As shown in FIG. 14 the pilot PN chip rate of 1.2288 MHz can be expressed as a digital signal of 0s and 1s.

When this 1.2288 MHz signal is divided by 64 by the frequency division counter 17*c*, the result is the Walsh code (32) of which the 32 chips in the first half are 0s and the 32 chips in the second half are 1s as shown in FIG. 13.

In ST9, the pilot PN code is first mixed with the sync channel signal, that is, the signal received form the CDMA base station 15*a*, and the signal is despread using the Walsh code (32) generated by the divide-by-64 counter 17*c* at the synchronization timing that can be recognized from the beginning of the pilot PN code. The signal is then passed through the digital filter 17*d* and deinterleaving and decoding unit 17*e* to receive the sync channel message in FIG. 12.

As shown in FIG. 12 the sync channel message contains time information (including the SYS_TIME). The signal transmitted from the CDMA base station 15*a* described above is therefore an example of a prescribed signal containing time information, and the time information can be extracted using the Walsh code (32) from the signal transmitted from the CDMA base station 15*a*.

The divide-by-64 counter 17*c* in FIG. 3 is an example of a time information extraction signal supply unit that supplies only the time information extraction signal, that is, Walsh code (32).

In this embodiment of the invention as shown in FIG. 13A and FIG. 13B, the CDMA base station 15*a* transmits a pilot channel signal indicating the starting part of the sync channel signal (the part indicated by the vertical arrow in FIG. 13), which is a prescribed signal containing time information, with the sync channel signal, and the start timing generator 17*b* supplies the start timing, which is a start signal, referenced to the pilot channel signal to the divide-by-64 counter 17*c*.

Whether receiving the sync channel message is completed is then determined in ST10. If sync channel message reception is not completed, whether reception timed out is determined in ST11. If reception timed out, the sync channel message is received again in ST8.

This embodiment of the invention can thus generate the Walsh code (32) that is required to extract the sync channel message from the sync channel signal transmitted from the CDMA base station 15*a* by means of the divide-by-64 counter 17*c*, and does not require a Walsh code generator to generate the 64 types of Walsh codes as is required by the related art.

The circuit synchronize can therefore be reduced and power consumption can be reduced.

More specifically, the divide-by-64 counter 17*c* in this embodiment of the invention can generate the Walsh code (32) as shown in FIG. 13B and FIG. 14 by simply frequency dividing the reference frequency of 1.2288 MHz, which is the pilot PN chip rate. The invention can therefore be realized using an extremely simple circuit arrangement and power consumption in particular can be reduced.

In addition, because frequency dividing by the divide-by-64 counter 17*c* is based on the start timing signal from the start timing generator 17*b*, which is referenced to the pilot PN signal synchronization timing, the sync channel message can be reliably extracted from the sync channel signal.

If it is determined in ST10 that sync channel message reception finished, control goes to ST12 and signal reception by the CDMA base station signal receiver 24 in FIG. 3 is stopped. More specifically, the receiver control program 35 operates to stop the CDMA base station signal receiver 24 from receiving signals from the CDMA base station 15*a*. Signal reception thus ends at the timing of the end of the last superframe denoted by E and EE in FIG. 11.

This results in the wristwatch 10 receiving the entire sync channel message shown in FIG. 12 and this sync channel message is stored in the sync channel message data storage unit 51 in FIG. 7 as the sync channel message data 61*a*.

Control then goes to ST13. The steps from ST13 are the steps for deciding if the time of the wristwatch 10 can be adjusted based on the received time information, such as the GPS time in the SYS_TIME field of the sync channel message received in ST9.

In this embodiment of the invention the wristwatch 10 has a circuit design and parameters for adjusting the time based on the reliability of the time information in the sync channel message received from a CDMA base station 15*a* of cell phone service provider (A), a specific cell phone service provider. Whether the sync channel message is from a CDMA base station 15*a* of the cell phone service provider (A) is therefore determined from ST13.

More specifically, the system ID value is carried in the SID field of the sync channel message transmitted from each CDMA base station 15*a* as shown in FIG. 12.

This system ID is a number such as "1234," and if the system ID is the same number, the sync channel message is known to be from a CDMA base station 15*a* that is managed by the same cell phone service provider.

The following steps are therefore executed. The SID data is first read in ST13 in FIG. 9 (an example of a base station identification information acquisition unit). More specifically, the SID data acquisition program 317 in FIG. 5 operates to get the value in the SID field in FIG. 12 from the sync channel message data 51*a* in FIG. 7.

Control then goes to ST14. Whether the received SID value matches the registered SID value is determined in ST14 (an example of a step determining if time adjustment is possible).

More specifically, the wristwatch 10 stores SID values identifying the CDMA base stations 15*a* that transmit time information that can be used by the wristwatch 10 to adjust the time with good precision. These values are the registered SID data 49*a* shown in FIG. 6, and in this embodiment of the invention the registered SID data 49*a* is the number "1234" identifying the CDMA base stations 15*a* that are operated by the cell phone service provider (A). The registered SID data 49*a* is stored in the registered SID data storage unit 49 shown in FIG. 6.

The SID data evaluation program 318 in FIG. 5 then operates in ST14, and the system ID value in the sync channel message that was received in ST13 is compared with the registered SID data 49*a* in FIG. 6 to determine if the numbers are the same.

If ST14 determines that the system IDs are the same, the specific time adjustment process continues from ST15 in FIG. 9. If ST14 determines the system IDs are different, that is, do not match, the likelihood is high that the received sync channel message does not contain time information that the wristwatch 10 considers sufficiently reliable, the time adjustment steps therefore do not execute, and operation ends.

In this embodiment of the invention the wristwatch 10 is an arrangement that considers only data about the reliability, for example, of the time information in the sync channel messages from CDMA base stations 15*a* operated by cell phone service provider (A), determines if a sync channel message is from a CDMA base station 15*a* that is considered reliable, executes the specific time adjustment steps if the information is reliable, and does not execute the time adjustment steps if the information is not reliable.

Therefore, because the wristwatch 10 does not require a circuit design that considers data on the reliability, for example, of time information from multiple different cell phone service providers, the manufacturing cost of the wristwatch 10 can be reduced.

Furthermore, while the design is simplified, the precision of the time adjustment is not reduced, and the time can be adjusted with extremely high precision.

The system ID in FIG. 12 is an example of base station identification information, and the SID data acquisition program 317 is an example of a base station identification information acquisition unit. The registered SID data storage unit 49 is an example of a base station identification standard information storage unit, and the SID data evaluation program 318 is an example of a time adjustment execution determination unit.

Control then goes to ST15. From ST15 is the process for producing the time adjustment data and actually adjusting the time based on information in the sync channel message already acquired from the CDMA base station 15*a*.

The data for adjusting the time is produced using the leap seconds data shown in FIG. 12 in the sync channel message. The leap seconds data in FIG. 12 is therefore assumed to be correct. However, the leap seconds data in the sync channel message in FIG. 12 is often not accurate.

More specifically, the GPS time (SYS_TIME) is a time value that does not consider the Earth's rotation, the time must therefore be corrected to get the actual time on Earth, and this adjustment data is the leap seconds value. However, this leap seconds data is typically not accurately changed at the CDMA base station 15*a* when the data is implemented, such as at 0:00 or 9:00 a.m. on January 1, and the CDMA base station 15*a* data is usually changed sometime before, such as approximately a maximum six months before.

If the leap seconds value that is to be applied from 0:00 on January 1 of the next year is "14 seconds," for example, and the leap seconds value used until then is "13 seconds," the new leap seconds value of "14 seconds" is already changed in the sync channel data in July of the previous year.

As a result, the time will be 1 second late until 0:00 on January 1 of the next year, and the time cannot be accurately adjusted.

The following process is therefore executed.

First, in ST15, the GPS time SYS_TIME and the leap seconds LP_SEC, such as "14" seconds, are first acquired from the received sync channel message (sync channel message data 51*a* in FIG. 7), and the UTC time (Universal Time Code) is calculated.

The UTC is the year, month, day, hour, minute, and second of Greenwich Mean Time.

More specifically, the UTC time calculation program 312 in FIG. 5 operates and the UTC is calculated based on the GPS time and the leap seconds value.

The calculated UTC time is then stored as the UTC time data 57*a* in FIG. 7 to the UTC time data storage unit 57.

Whether the leap seconds data that was received differs from the registered leap seconds data is then determined in ST16.

More specifically, a registered received leap seconds data storage unit 59 that stores the registered received leap seconds data 59*a* is provided in the second data storage unit 50 as shown in FIG. 7 for remembering the leap seconds value of the sync channel message (see FIG. 12) that was previously received from the CDMA base station 15*a*.

The leap seconds comparison program 314 in FIG. 5 then compares the leap seconds value in the sync channel message that was just received in ST9 above with the registered received leap seconds data 59*a*, and determines if the values are the same.

For example, if 13 seconds was received on August 20 and stored as the registered received leap seconds data, and 14 seconds is received as the current leap seconds data on August 30, the registered received leap seconds data and the currently received leap seconds data are different.

In this case the "14 second" value is known to be the leap seconds value that should be used, for example, from 0:00 of January 1 of the next year.

The registered received leap seconds data storage unit 59 and the sync channel message data storage unit 51 are thus an example of a leap seconds information storage unit. The leap seconds comparison program 314 is an example of a leap seconds change determination unit.

The registered received leap seconds data 59*a* can also be manually corrected by the user of the wristwatch 10.

If the leap seconds data is determined to be different in ST16, the leap seconds data that was received has changed and is the value for the next year, for example. Whether this leap seconds data should be used or not is then determined in ST17.

Whether the UTC time data 57*a* indicates 23:59:59 on June 30 or December 31 is then determined in ST17.

More specifically, whether the time has come when the currently received leap seconds data that was received in ST9 should actually be used (applied) is determined.

More specifically, the leap seconds correction determination program 316 makes this decision based on the UTC time data 57*a* in FIG. 7 and the leap seconds correction time data 48*a* in FIG. 6. Data such as 23:59:59 on June 30 or December 31 is stored in the leap seconds correction time data 48*a* as the correction time used for evaluation.

The leap seconds correction time data storage unit 48 in FIG. 6 is an example of a leap seconds application time information storage unit.

If the UTC time data 57*a* indicates the time when the received leap seconds value is to be used, the leap seconds data that was just received (such as "14 seconds" in this example) is stored in ST18 as the registered received leap seconds data 59*a* and control goes to ST19.

In ST19 the current-reception-based first local time data 52*a* in FIG. 7 is calculated by the first local time calculation program 36 in FIG. 5.

The current-reception-based first local time data 52*a* is described next.

Because the wristwatch 10 in this embodiment of the invention is in Japan, for example, the GPS time, the currently received leap seconds, local offset time (UTC+9 in the case of Japan), and daylight savings time adjustment (0 hours in this example because there is no daylight savings time in Japan) are extracted from the sync channel message data 51*a* in FIG. 7, and the current received first local time, the first Japan time in this example, is calculated.

More specifically, the UTC is calculated referenced to the GPS time and the current received leap seconds data, for example, and the local time is calculated by adding the local offset time to the UTC time. In this example 9 hours is added to the UTC time to get Japan time. Because daylight savings time is not used in Japan, there is no adjustment for daylight savings time. In countries such as the United States where daylight savings time is used, the corrected daylight savings time is set with extremely high precision.

The current-reception-based first local time data 52*a* thus calculated is then stored in the current-reception-based first local time data storage unit 52 in FIG. 7.

The current-reception-based first local time data 52*a* thus uses the leap seconds data that was changed by the CDMA base station 15*a*, but this leap seconds value is applied at the correct time so that the time information is highly precise.

If the currently received leap seconds data does not differ from the registered leap seconds data in ST16, that is, even when the leap seconds values are the same, the first local time is calculated in ST19.

Unlike when ST16 returns Yes, however, the currently received leap seconds data has not been changed by the CDMA base station 15*a*. In this case, therefore, the current-reception-based first local time data 52*a* is calculated in ST19 based on a leap seconds value that has not changed.

If ST17 returns No, that is, the UTC time data 57*a* is not the specified time on June 30 or December 31, the currently received leap seconds data has changed but is not the leap seconds data to be applied at the current time.

If the time is adjusted using the currently received leap seconds data in this case, the time will be slow by the amount that the leap seconds value has changed, that is, by 1 second in the above example, and the time cannot be adjusted accurately.

Therefore, if ST17 returns No, this embodiment of the invention goes to ST20. Step ST20 calculates the registered-reception-based first local time data 58*a* based on the registered received leap seconds data 59*a* in FIG. 7 instead of the currently received leap seconds data.

As a result, the leap seconds data that matches the period when it should be applied is used to produce the data for adjusting the time, and the time can be prevented from being fast or slow by one second as happens with the related art.

This embodiment of the invention thus calculates the current-reception-based first local time data or the registered-reception-based first local time data as the first Japan time, and this time is the basic time based on the GPS time and the leap seconds data that is applicable to when the time is being set.

The current-reception-based first local time data 52*a* that is calculated here is described next. The current-reception-based first local time data 52*a* is described with reference to FIG. 11.

When the wristwatch 10 receives the signal from the CDMA base station 15*b* in FIG. 11 and extracts the sync channel message, the received time (GPS time) is the time (the time at F in FIG. 11) four superframes (320 ms) after the end of the last superframe referenced to the time with a pilot PN offset of 0 chips (0 ms).

However, because the pilot PN offset of signals transmitted from the CDMA base station 15*b* in FIG. 11 is 64 chips (0.052 ms), the actual signal reception time differs by the same amount from the accurate GPS time. In other words, the actual time (EE) at the end of the last superframe transmitted from the CDMA base station 15*b* in FIG. 11 is the time of the GPS time acquired by the wristwatch 10 plus the pilot PN offset.

The invention therefore executes the following process. That is, the first local time data 52*a* in FIG. 7 is corrected as follows in ST21. The time at F in FIG. 11 is adjusted to the time at E by subtracting 320 ms (4 superframes) from the current-reception-based first local time data 52*a*. Because the pilot PN offset of signals from the CDMA base station 15*b* is 0.052 ms, this offset is then added.

The time, Japan time in this example, can therefore be generated based on the correct GPS time at the end of reception (EE) of the last superframe.

The second local time calculation program 37 in FIG. 5 does this calculation based on the current-reception-based first local time data 52*a* or the registered-reception-based first local time data 58*a* in FIG. 7 and the time difference data 44*a* and the pilot PN offset time data 45*a* in FIG. 6, and stores the result as the second local time data 53*a* to the second local time data storage unit 53 in FIG. 7.

An example of the time difference data 44*a* in FIG. 6 is the value of 320 ms (4 superframes) used above, and is stored in the time difference data storage unit 44.

An example of the pilot PN offset time data 45*a* is the value of 64 chips (0.052 ms) used above, and is stored in the pilot PN offset time data storage unit 45.

The GPS time acquired from the sync channel message in ST9 is an example of the future time information at a prescribed time after (such as 320 ms after) the reception time information (such as the time at E in FIG. 11), which is the time when the reception unit (such as the CDMA base station signal receiver 24) receives.

The time difference data 44*a* in FIG. 6 is an example of time difference information.

The first local time calculation program 36 and the second local time calculation program 37 are an example of the reception time information generating unit that generates the reception time information of the reception unit (such as the second local time data 53*a*) based on the future time information (such as the time at F in FIG. 11) received by the reception unit (such as the CDMA base station signal receiver 24) and the time difference information (such as the time difference data 44*a*).

The second local time data 53*a* calculated in ST21 is a highly precise time matching the GPS time, but because time is required for the calculations done in ST19 or ST20 and ST21, the time differs (is inaccurate) from the precise GPS time by an amount equal to this calculation time.

ST22 is executed to compensate for this calculation time. More specifically, a process delay time is added to the second local time data 53*a* in FIG. 7 to calculate the final local time. More specifically, this process delay time is equal to the time required for these calculations by the wristwatch 10, and this time is therefore determined by the wristwatch 10.

In this embodiment of the invention the process delay time data 46*a* is therefore stored in the process delay time data storage unit 46 as a constant value as shown in FIG. 6. The final local time calculation program 38 in FIG. 5 then adds the process delay time data 46*a* to the second local time data 53*a* in FIG. 7, and stores the result as the final local time data 54*a*, which is a more precise time, in the final local time data storage unit 54.

The resulting final local time data 54*a* is highly precise time information reflecting the GPS time and the leap seconds value.

Control then goes to ST23. In ST23 the RTC and time adjustment program 39 in FIG. 5 adjusts the RTC 25 in FIG. 4 and the hands 13 in FIG. 1 based on the final local time data 54*a* in FIG. 7, and completes the time adjustment.

This embodiment of the invention can more accurately adjust the time because the leap seconds data acquired from the CDMA base station 15*a* is used accurately according to the period when the leap seconds data should be applied.

The RTC and time adjustment program 39 is thus an example of a display time information adjustment unit that adjusts the display time information of the time information display unit (such as the RTC 25 and the hands 13). The final local time calculation program 38 is an example of an adjustment time information generating unit that generates the adjustment time information (such as the final local time data 54*a*) used for adjustment by the RTC and time adjustment program 39.

As described above the RTC and time adjustment program 39 is an arrangement for adjusting the RTC 25, for example, based on the leap seconds information (such as the currently received leap seconds data) and the leap seconds application time information (including leap seconds correction time data 48*a*).

The RTC and time adjustment program 39 is also an arrangement for adjusting the RTC 25, for example, based on the leap seconds correction time data 48*a* and the leap seconds data which the leap seconds comparison program 314 determines if it has changed.

This embodiment of the invention can reduce power consumption from the battery 27 because the CDMA base station signal receiver 24 stops reception of signals from the CDMA base station 15*a* in ST12.

This is described more specifically with reference to FIG. 11. In FIG. 11 (C) denotes the power sequence of the related art when receiving the sync channel message from the CDMA base station 15*b* and then synchronizing the time. As shown in FIG. 11 the power remains on until FF in FIG. 11 because signals are being received.

This compares with the power sequence of this embodiment of the invention denoted by (D) in FIG. 11. As shown by (D) signal reception ends at EE in FIG. 11 and communication does not continue thereafter.

Because the wristwatch 10 according to this embodiment of the invention can reduce power consumption, the invention can be used in devices such as timepieces that require very little power while also enabling adjusting the time with extremely high precision.

Control then goes to ST24. A time adjustment interval timer operates in ST24. More specifically, the start time adjustment decision program 311 in FIG. 5 operates and references the time adjustment interval data 47*a* in FIG. 6. This time adjustment interval data 47*a* is 24 hours in this embodiment. The time adjustment interval data 47*a* is stored in the time adjustment interval data storage unit 47.

As a result, the next time adjustment process starts 24 hours after the previous time adjustment in ST25, and the process repeats from ST1.

FIG. 8 to FIG. 10 describe a process whereby the local offset time and the daylight savings time data in FIG. 12 are automatically adjusted based on the sync channel message received from the CDMA base station 15*a*, but this data can alternatively be set by the user of the wristwatch 10.

In this case the local offset time that is input using the crown 28 in FIG. 1, for example, is stored as the input local offset time data 55*a* in FIG. 7 to the input local offset time data storage unit 55. The similarly input daylight savings time data is stored as the input daylight savings time data 56*a* in the input daylight savings time data storage unit 56.

The current-reception-based first local time data 52*a*, for example, is calculated based on this input data in ST19 or ST20 described above, and the time can therefore be adjusted as desired by the user.

This embodiment is described using by way of example adding "1 second" as the leap seconds in the CDMA base station 15*a*, but the invention is not so limited and includes arrangements in which "1 second" is subtracted.

Furthermore, Walsh code (32) is generated by the frequency division counter 17*c*, for example, in the above embodiment, but the invention is not so limited. Alternatively, a code signal for the Walsh code (32) shown in FIG. 13B and FIG. 14 can be stored in FIG. 6 and mixed with the sync channel signal by the baseband unit 17 in FIG. 3.

This arrangement enables reducing the circuit size even more, and reduces the power consumption.

The storage unit for the Walsh code (32) in this variation is a time information extraction signal storage unit.

The invention is not limited to the foregoing embodiment. Whether to apply the leap seconds value is determined above referenced to 23:59:59 on June 30 or December 31, but the invention is not so limited and a reference time of 00:00:00 on July 1 or January 1, or 00:00:30 on July 1 or January 1, can be used.

This arrangement is effective when the CDMA base station 15*a* inserts (changes) the leap seconds value at 23:59:59 on June 30 or December 31 or later.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A time adjustment device comprising:

a reception unit that receives a prescribed signal transmitted by a base station, the prescribed signal containing future time information, time difference information and base station identification information;

a reception time information generating unit that generates reception time information based on the future time information and the time difference information;

a time difference information storage unit that stores the time difference information;

a display time information adjustment unit that adjusts the time information displayed by a time information display unit;

an adjustment time information generating unit that generates adjustment time information, for use by the display time information adjustment unit, based on the reception time information and at least processing time information for the time adjustment device;

a base station identification information acquisition unit that gets the base station identification information contained in the prescribed signal; and a time adjustment execution determination unit that decides based on the base station identification information whether the display time information adjustment unit adjusts the displayed time information using the adjustment time information.

2. The time adjustment device described in claim 1, further comprising a base station identification standard information storage unit that stores base station identification standard information that is the basis for decisions by the time adjustment execution determination unit.

3. The time adjustment device described in claim 1, wherein the prescribed signal is a sync channel message, and the base station identification information is a system ID indicating that a base station is operated by a prescribed cell phone service provider.

4. The time adjustment device described in claim 1, further comprising:

a leap seconds information storage unit for storing leap seconds information that is time adjustment information based on rotation of the Earth and is contained in the time information; and a leap seconds application time information storage unit that stores leap seconds application time information for adjusting the displayed time information based on the leap seconds information;

wherein the display time information adjustment unit corrects the displayed time information based on the leap seconds information and the leap seconds application time information.

5. The time adjustment device described in claim 1, further comprising:

a time information extraction signal supply unit that supplies only a time information extraction signal;

wherein the time information is extracted from the prescribed signal using the time information extraction signal.

6. A timepiece device having a time adjustment device, comprising:

a reception unit that receives a prescribed signal transmitted by a base station, the prescribed signal containing future time information, time difference information and base station identification information;

a reception time information generating unit that generates reception time information based on the future time information and the time difference information;

a time difference information storage unit that stores the time difference information;

a display time information adjustment unit that adjusts the time information displayed by a time information display unit;

an adjustment time information generating unit that generates adjustment time information, for use by the display time information adjustment unit, based on the reception time information and at least processing time information for the time adjustment device;

a base station identification information acquisition unit that gets the base station identification information contained in the prescribed signal; and a time adjustment execution determination unit that decides based on the base station identification information whether the display time information adjustment unit adjusts the displayed time information using the adjustment time information.

7. A time adjustment method for a time adjustment device, comprising:

receiving a prescribed signal transmitted by a base station, the prescribed signal containing future time information, time difference information and base station identification information;

generating reception time information based on the future time information and the time difference information;

storing the time difference information;

adjusting displayed time information;

generating adjustment time information, for use in the adjusting step, based on the reception time information and at least processing time information for the time adjustment device;

acquiring the base station identification information contained in the prescribed signal; and deciding based on the base station identification information whether to adjust the displayed time information using the adjustment time information.

* * * * *